US008909084B2

(12) United States Patent
Fujii

(10) Patent No.: US 8,909,084 B2
(45) Date of Patent: Dec. 9, 2014

(54) FIXING DEVICE

(71) Applicant: Makoto Fujii, Tokyo (JP)

(72) Inventor: Makoto Fujii, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/662,367

(22) Filed: Oct. 26, 2012

(65) Prior Publication Data

US 2013/0108300 A1 May 2, 2013

(30) Foreign Application Priority Data

Oct. 27, 2011 (JP) ..... 2011-235942

(51) Int. Cl.
*G03G 15/20* (2006.01)

(52) U.S. Cl.
CPC .... *G03G 15/2042* (2013.01); *G03G 2215/2029* (2013.01)
USPC ..... 399/69; 399/330; 399/334

(58) Field of Classification Search
USPC ..... 399/69, 330, 334
See application file for complete search history.

(56) References Cited

U.S. PATENT DOCUMENTS

| | | | | |
|---|---|---|---|---|
| 4,952,084 | A | 8/1990 | Maruyama | |
| 7,333,743 | B2 * | 2/2008 | Kishi et al. | 399/69 |
| 8,019,247 | B2 * | 9/2011 | Mito et al. | 399/69 |
| 2005/0175367 | A1 * | 8/2005 | Urabe | 399/69 |
| 2007/0292155 | A1 * | 12/2007 | Kida | 399/69 |
| 2009/0196643 | A1 * | 8/2009 | Mito et al. | 399/69 |
| 2010/0054785 | A1 * | 3/2010 | Ogiso et al. | 399/69 |
| 2011/0164890 | A1 * | 7/2011 | Ota | 399/43 |
| 2012/0230719 | A1 * | 9/2012 | Matsumoto | 399/69 |

FOREIGN PATENT DOCUMENTS

| | | | |
|---|---|---|---|
| JP | 64-040350 | 10/1989 | |
| JP | 2001-305906 | 2/2001 | |
| JP | 2003-043852 | 2/2003 | |
| JP | 2004-258567 | 9/2004 | |
| JP | 2004258567 A * | 9/2004 | G03G 15/20 |

OTHER PUBLICATIONS

Machine translation of JP 2004258567 A, Takeshita et al.*
Takeshita et al, JP 2004258567 A—English translation.*
Notice of Reasons for Rejection for JP 2011-235942, dispatched Oct. 1, 2013, 3 pgs.
Translation of the Notice of Reasons for Rejection for JP 2011-235942, dispatched Oct. 1, 2013, 5 pgs.

* cited by examiner

*Primary Examiner* — Walter L Lindsay, Jr.
*Assistant Examiner* — Arlene Heredia Ocasio
(74) *Attorney, Agent, or Firm* — Squire Patton Boggs (US) LLP

(57) ABSTRACT

A fixing device is provided that can limit a temperature rise in paper non-contact edge portions with a relatively simple configuration and can make uniform a temperature distribution across a paper feed region. A heating roller includes lamps that respectively heat a center region and a large edge region and a small edge region, a temperature sensor for a heat generating region of the center lamp, a temperature sensor for a heat generating region of the edge-side lamps, and a temperature sensor for a paper non-contact edge portion. The heating roller selects any one of the edge-side lamps based on a detection result from the temperature sensor for the paper non-contact edge portion.

12 Claims, 12 Drawing Sheets

| | CENTER LAMP (LAMP 1) | LARGE EDGE-SIDE LAMP (LAMP 2) | SMALL EDGE-SIDE LAMP (LAMP 3) |
|---|---|---|---|
| DURING WARM-UP AND IDLING | GOOD | GOOD | BAD |
| A3 | GOOD | FAIR | FAIR |
| B4 | GOOD | FAIR | FAIR |
| A4S | GOOD | FAIR | FAIR |

FIG.4

| SHEET WIDTH L | SET VALUES FOR TEMPERATURE SENSOR 12 | SET VALUES FOR TEMPERATURE SENSOR 13 |
|---|---|---|
| | (℃) | (℃) |
| 0<L≦160 | -40 | -30 |
| 160<L≦180 | -20 | -30 |
| 180<L≦200 | -10 | -20 |
| 200<L≦220 | 0 | -10 |
| 220<L≦240 | 0 | -10 |
| 240<L≦260 | 0 | -10 |
| 260<L≦280 | 0 | 0 |
| 280<L≦300 | 0 | +10 |
| 300<L | 0 | +10 |

FIG.8

TEMPERATURE
SET TEMPERATURE VALUE
TEMPERATURE DETECTED BY TEMPERATURE SENSOR 12
TIME

TEMPERATURE
SET TEMPERATURE VALUE
TEMPERATURE DETECTED BY TEMPERATURE SENSOR 13
TIME

SELECT LAMP 2
SELECT
NOT SELECT
SELECT LAMP 3
SELECT
NOT SELECT

ON, OFF OF LAMP 2 OR LAMP 3
ON
OFF

LAMP 2 ON, OFF
ON
OFF

LAMP 3 ON, OFF
ON
OFF

| ITEM | COMPARATIVE EXAMPLE 1 (FIG.10) | EMBODIMENT (FIG.1) |
|---|---|---|
| FLICKERING | BAD | GOOD |
| END TEMPERATURE RISE | BAD | GOOD |
| TEMPERATURE UNIFORMITY ACROSS SHEET | GOOD | GOOD |

| ITEM | COMPARATIVE EXAMPLE 2 (FIG. 12) | EMBODIMENT (FIG. 1) |
|---|---|---|
| FLICKERING | GOOD | GOOD |
| EDGE-PORTION TEMPERATURE RISE | BAD | GOOD |
| TEMPERATURE UNIFORMITY ACROSS SHEET | FAIR | GOOD |

FIXING DEVICE

CROSS REFERENCE TO RELATED APPLICATIONS

This application is entitled and claims the benefit of Japanese Patent Application No. 2011-235942, filed on Oct. 27, 2011, the disclosure of which including the specification, drawings and abstract is incorporated herein by reference in its entirety.

TECHNICAL FIELD

The present invention relates to fixing devices for use in image forming apparatus such as copiers and laser beam printers.

BACKGROUND ART

Conventionally, electrophotographic image forming apparatus (e.g., copiers and laser beam printers) are configured to rotate the photoconductor drum for evenly charging the entire surface of the photoconductor drum. An electrostatic latent image is then formed on the photoconductor drum by sweeping a laser beam over the photoconductor's surface. A toner image, an image developed by a toner deposited on the electrostatic latent image, is transferred onto a sheet and is fixed to the sheet by a fixing device.

Fixing devices used for this purpose include heating roller fixing devices. The heating roller fixing include: directly heating a target sheet by a heating roller; heating a fixing belt by a heating roller followed by heating the target sheet by the heated fixing belt; and so forth.

A heat generating lamp, a heat generating source, is incorporated inside the heating roller.

In recent years, it has been required in the art for fixing devices to be capable of accommodating multiple sheet sizes while consuming as little electric power as possible and of obtaining high image quality through a uniform fixing temperature distribution.

Heretofore, configurations in which a plurality of heat generating lamps are provided in the heating roller in order to accommodate a plurality of sheet sizes are disclosed in, for example, Patent Literatures 1 and 2.

Patent Literature 1 discloses a fixing device that includes a plurality of heating lamps for different sheet sizes.

Patent Literature 2 discloses a fixing device that includes a first heat generating lamp having a heat generating region at a position corresponding to the center and its vicinity of a sheet in order to heat the central region of the sheet, and a second heat generating lamp having a heat generating region at positions corresponding to the edges and their vicinity of the sheet in order to heat the edge regions of the sheet. The fixing device turns on only the first heat generating lamp when a small-sized sheet is fed, and turns on both the first and second heat generating lamps when a large-sized sheet is fed. Consequently, the fixing device can accommodate a plurality of sheet sizes.

CITATION LIST

Patent Literature

PTL 1: Japanese Examined Patent Application Publication No. 01-40350

PTL 2: Japanese Patent Application Laid-Open No. 2001-305906

SUMMARY OF INVENTION

Technical Problem

Patent Literature 1 employs a heat generating lamp having a long heat generating region in order to accommodate large-sized sheets. However, when the heat generating region of the heat generating lamp is elongated (i.e., heat generation length is enlarged), it results in increased lamp power consumption, which is disadvantageous in terms of power saving.

Moreover, larger heat generation lengths causes a large power drop when the heat generating lamp is turned on, leading to significant flickering. Therefore, flickering of illumination and negative impacts on other electronic devices are more likely to occur. When an electric circuit is provided for preventing flickering, inconvenience occurs such as increased board space for the electric circuit, and complicated structure.

The fixing device disclosed in Patent Literature 1 is configured to perform an overall temperature control, which inevitably entails a temperature control for the central region; it is unable to perform a fine temperature control, e.g., extensively raising the temperature of the edge portions.

Furthermore, the fixing device disclosed in Patent Literature 1 is not so configured as to precisely control the temperature of paper non-contact edge portions—regions other than the paper feed region. In the fixing device, a temperature rise in the paper non-contact edge portions becomes problematic. Namely, as the paper non-contact edge portions are regions that do not come in contact with a paper sheet, they are not deprived of heat by the paper sheet; therefore the temperature of the paper non-contact edge portions tends to rise. The temperature rise in the paper non-contact edge portions causes damages to fixing members. Further, the temperature rise in the paper non-contact edge portions results in a phenomenon in which a temperature rise occurs in the vicinity of the edge portions due to the increased temperature of the paper non-contact edge portions. As a result, the temperature distribution across the sheet becomes non-uniform, resulting in serious problems such as poor fixing performance.

The fixing device disclosed in Patent Literature 2 is so configured that the heat generation length of the heat generating lamp is made small compared to that disclosed in Patent Literature 1, thus offering such advantages as power saving and less flickering. Moreover, the fixing device disclosed in Patent Literature 2 is so configured that the temperature in the paper feed region is detected by a temperature sensor and that the temperature of the paper feed region, including the edges of the paper feed region, is controlled using separate heat generating regions based on the detected temperature. Therefore, compared with Patent Literature 1, a temperature distribution across a sheet, including its edges, is considered to be easily made uniform.

However, Patent Literature 2 fails to fully consider the temperature of the paper non-contact edge portions, and therefore, it is likely that the temperature of the paper non-contact edge portions rises and damages the fixing member.

It is an object of the present invention to provide a fixing device that can limit a temperature rise in the paper non-contact edge portions with a relatively simple configuration and to make uniform a temperature distribution across the paper feed region.

Solution to Problem

To achieve at least one of the abovementioned objects, a fixing device reflecting one aspect of the present invention is a fixing device that includes a heating roller incorporating therein heat generating lamps and is configured to heat a sheet having thereon a toner image to fix the toner image, the fixing device including:

a first heat generating lamp including a first heat generating region;

a second heat generating lamp including a second heat generating region in a region corresponding to a region extending from an end of the first heat generating region;

a third heat generating lamp including a third heat generating region in a region corresponding to the region extending from the end of first heat generating region, the third heat generating region having a length different from a length of the second heat generating region;

a first temperature sensor arranged closer to an edge of the heating roller than are the first, second and third heat generating regions, the first temperature sensor being configured to detect an edge-portion temperature of the heating roller; and a heating control section configured to control heat generation of the second and third heat generating regions based on a detection result from the first temperature sensor.

BRIEF DESCRIPTION OF DRAWINGS

FIG. 4 is a diagram showing combinations of lamps to be used;

FIG. 8 is a diagram showing a table for lamp switching;

DESCRIPTION OF EMBODIMENTS

Embodiments of the present invention will now be described in detail with reference to the accompanying drawings.

Figure 1:
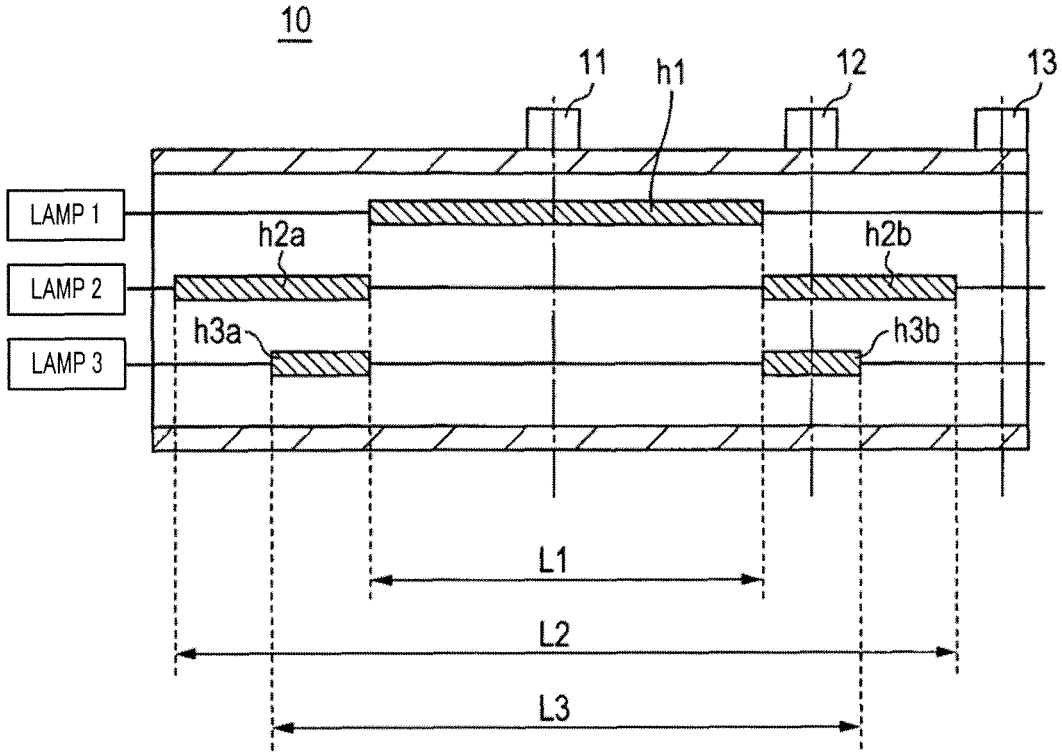
FIG. 1 is a sectional view showing a configuration of a heating roller according to an embodiment.
Figure 2:
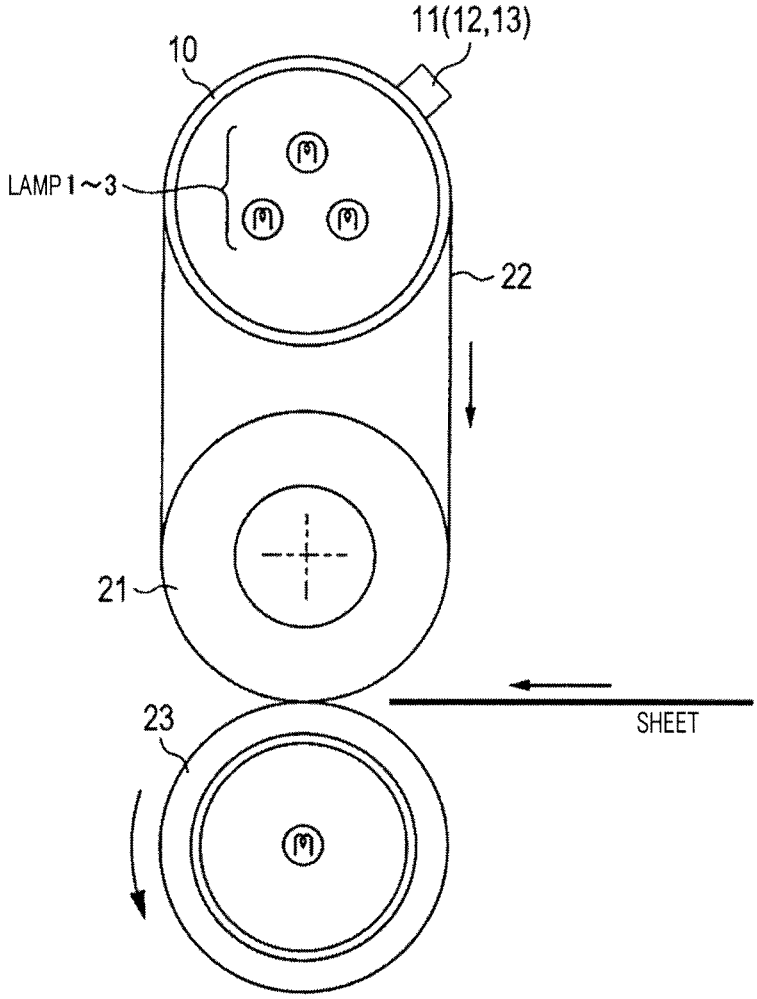
FIG. 2 is a diagram showing a schematic configuration of a fixing device in which the heating roller is used.

The configuration of a fixing device according to an embodiment is shown in FIGS. 1 and 2.

FIG. 1 shows the configuration of a heating roller according to this embodiment. FIG. 1 is a substantially linear sectional view of the heating roller taken along its longitudinal direction (i.e., rotation axis direction). FIG. 2 is a diagram showing a schematic configuration of a fixing device in which heating roller 10 shown in FIG. 1 is used. FIG. 2 is a substantially linear sectional view of heating roller 10 taken along a surface perpendicular to the longitudinal direction (i.e., the rotation axis direction).

Three heat generating lamps 1, 2, 3 are incorporated in heating roller 10.

Heat generating lamp 1 includes heat generating region h1 at substantially the center in the longitudinal direction of heating roller 10. The heat generating region is, for example, a region in which a heat generating coil is arranged. Length L1 of heat generating region h1 is large enough to cover a paper feed region for an assumed minimum sheet size, e.g., postcard size. In the case of this embodiment, length L1 of heat generating region h1 is about 200 mm.

Heat generating lamp 2 includes heat generating regions h2*a* and h2*b* (hereinafter may collectively referred to as heat generating region h2) in regions corresponding to regions extending from the ends of heat generating region h1. The length of heat generating region h2 is selected such that total length L2 of heat generating region h2 and heat generating region h1 is large enough to cover a large sheet size, i.e., A3 sheet size (297 mm in width). In the case of this embodiment, the length of heat generating region h2*a* and the length of heat generating region h2*b* are each set to 70 mm. Therefore, length L2 is set to 200 mm+2×70 mm=340 mm.

Heat generating lamp 3 includes heat generating regions h3*a* and h3*b* (hereinafter sometimes collectively referred to as heat generating region h3). The length of heat generating region h3 is selected such that a sum of the length of heat generating region h3 and the length of heat generating region h1 is large enough to cover a medium sheet size, i.e., B4 sheet size (257 mm in width). In the case of this embodiment, the length of heat generating region h3*a* and the length of heat generating region h3*b* are each set to 30 mm. Therefore, length L3 is set to 200 mm+2×30 mm=260 mm.

As seen from FIG. 1, heat generating regions h3*a* and h3*b* overlap the center-side portions of heat generating regions h2*a* and h2*b*, respectively, in the axial direction of heating roller 10.

Temperature sensors 11, 12, 13 are provided in contact with the surface of heating roller 10. Temperature sensors 11, 12, 13 are attached to a frame of the fixing device such that they come into contact with the surface of rotating heating roller 10.

Temperature sensor 11 is arranged at the lengthwise center of heating roller 10. Temperature sensor 12 is arranged at a position where heat generating regions h2*a* and h2*b* and heat generating regions h3*a* and h3*b* overlap each other. Temperature sensor 13 is arranged outside heat generating regions h2*a* and h2*b* (i.e., arranged at the edge side of heating roll 10), which are extended closer to the edges of heating roller 10 than any other heating generating regions are.

The region where heat generating regions h2*a* and h2*b* and heat generating regions h3*a* and h3*b* overlap each other is formed on the center side, and the temperature of this overlapping region is detected by one temperature sensor 12. Therefore, a plurality of heat generating regions h2 and h3 can be controlled by one temperature sensor 12. In this embodiment, two lamps (lamps 2 and 3) overlap each other. However, an overlapping region may be formed for three or more lamps and the temperature of this overlapping region may be detected by one temperature sensor. Consequently, it is possible to reduce the number of temperature sensors for detecting the edge-portion temperature and thus to simplify the configuration.

The configuration shown in FIG. 2, which is an application example of heating roller 10 shown in FIG. 1, will now be explained.

Fixing belt 22 is wrapped around heating roller 10 and fixing roller 21. Lower roller 23 is pressed against fixing roller 21. A sheet having thereon a toner image, which is formed by a photoconductor drum and other units, is carried in between fixing roller 21 and lower roller 23. Consequently, the toner image on the sheet is fixed by the heat of fixing belt 22 heated by heating roller 10.

Heating roller 10 according to this embodiment is applicable not only to indirect fixing that uses fixing belt 22 such as that shown in FIG. 2, but also to direct fixing. Specifically, heating roller 10 may be applied to a fixing scheme in which heating roller 10 and lower roller 23 are pressed against each other, and a fixing target sheet is delivered in between heating roller 10 and lower roller 23 for directly heating the sheet with heating roller 10, without using fixing belt 22.

Figure 3:
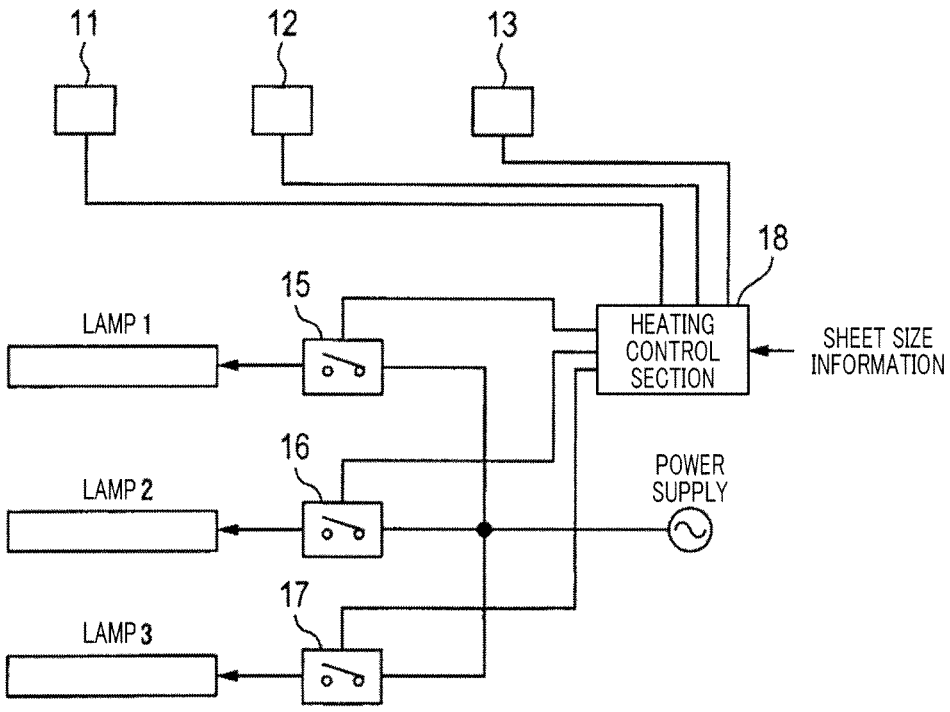
FIG. 3 is a diagram showing a configuration of an electric system of the heating roller.

FIG. 3 is a diagram showing the configuration of an electric system of heating roller 10.

Lamps 1, 2, 3 are respectively connected to a power supply via switches 15, 16, and 17 such as triacs. ON/OFF of switches 15, 16, 17 is controlled by heating control section 18 such as a CPU. Heating control section 18 controls ON/OFF of the switches based on the sheet size information and detected temperature information from temperature sensors 11, 12, and 13.

When the temperature detected by temperature sensor 11 provided at the center of heating roller 10 is equal to or lower than a set temperature value, switch 15 is turned on, whereby an electric power is supplied to lamp 1. When the detected temperature is higher than the set temperature value, switch 15 is turned off, whereby power supply is interrupted.

Concerning power supply to lamp 2 and lamp 3, when the power supply to any one of lamps 2 and 3 is performed, the power supply to the other is interrupted. Therefore, the power supply to both lamps 2 and 3 is not simultaneously performed (i.e., both lamps 2 and 3 are not simultaneously turned on).

FIG. 4 is a diagram showing combinations of lamps to be used. In the following explanation, lamp 2 may be referred to as a "large edge-side lamp" and lamp 3 as a "small edge-side lamp." A triangle mark in the drawing indicates that ON/OFF is switched based on the temperature detected by temperature sensor 13 for detecting the temperature of regions outside the heat generating region (i.e., temperature of paper non-contact edge portions).

During warm-up and idling, lamp 1 and lamp 2 are turned on to warm a wide region.

The ON/OFF of lamps 2, 3, which are edge lamps, is switched according to a temperature detected by temperature sensor 13 for detecting the temperature of the paper non-contact edge portions. In an example shown in FIG. 4, both of the large edge-side lamp (lamp 2) and the small edge-side lamp (lamp 3) can be used for both large size A3 paper and the small size A4 paper. However, in actual temperature control, a rate of use of the center lamp (lamp 1) and the large edge-side lamp (lamp 2) is high for A3 size, a rate of use of the center lamp (lamp 1) and the small edge-side lamp (lamp 3) is high for B4 size, and a rate of use of the center lamp (lamp 1) is high for A4 size.

Figure 5A:
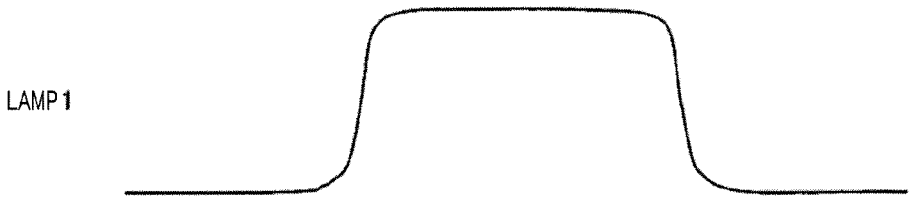
FIGS. 5A to 5C are diagrams showing heat distributions for respective lamps.
Figure 5B:
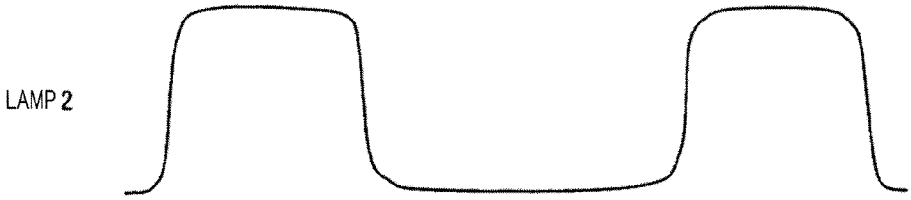
Figure 5C:
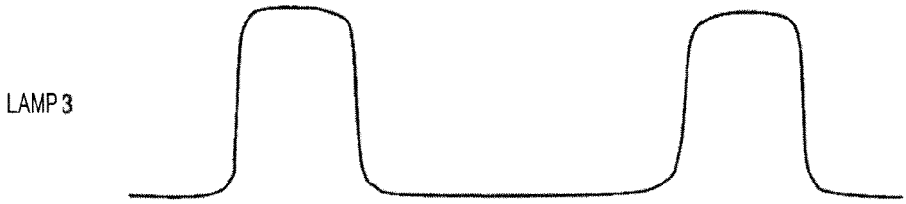

FIG. 5 is a diagram showing heat distributions of lamp 1 (FIG. 5A), lamp 2 (FIG. 5B), and lamp 3 (FIG. 5C).

Figure 6A:
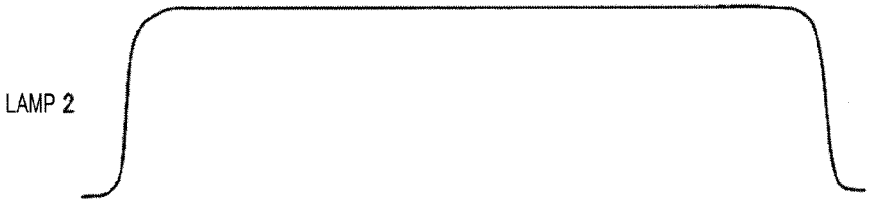
FIGS. 6A and 6B are diagrams showing heat distributions obtained when lamp energization is performed for different combinations of lamps.
Figure 6B:
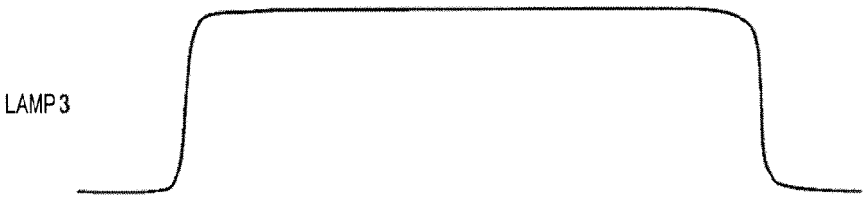

FIG. 6 is a diagram of heat distributions obtained when lamp energization is performed for a combination of lamp 1 and lamp 2 (FIG. 6A) and a combination of lamp 1 and lamp 3 (FIG. 6B).

A maximum heat distribution length for heating roller 10 is set to 340 mm, a heat distribution length at the time when lamp 1 and lamp 2 are energized. On the other hand, a maximum paper feed width is set to 330 mm and a maximum printing range to 320 mm. In this way, the maximum heat distribution length is set larger than the paper feed width and printing width. This is because, although heating roller 10 mainly includes rollers, since bearings, gears, and the like are arranged at the ends, a heat capacity at the edge is large and heat tends to dissipate from the edge. In this way, the maximum heat distribution length of the lamps is set larger than the paper feed width and the printing width. Consequently, it is possible to make the temperature distribution within the printing width of heating roller 10 flat even immediately after power-on, which is the timing when the edge-portion temperature tends to be low.

However, once paper feed is started, heating roller 10 is deprived of heat by the paper feed near the center of heating roller 10. However, a temperature rise occurs at the edge portions of heating roller 10 since a sheet does not come in contact with the edges portions. When the temperature rise is large, heating roller 10 and the fixing belt are likely to be broken. In a state in which non-uniformity has occurred in the temperature distribution across heating roller 10, when a sheet having such a size that the printing region comes in contact with the region with the non-uniform temperature distribution, the temperature distribution of the printing region becomes non-uniform. Therefore, the quality of a fixed image is likely to fluctuate in the axial direction of heating roller 10.

Thus, in heating roller 10 according to this embodiment, the large edge-side lamp (lamp 2) and the small edge-side lamp (lamp 3) having different heat distribution lengths are provided as the edge-side lamps. The use of the two lamps is switched according to the temperature detected by temperature sensor 13 for detecting the temperature of the paper non-contact edge portions. Consequently, a temperature rise at the paper non-contact edge portions can be limited, thus avoiding possible damages to the apparatus. Further, since the temperature distribution can be made uniform, it is possible to limit a reduction in image quality.

In actual use, heating roller 10 detects edge-portion temperatures using two temperature sensors 12 and 13 and performs the ON/OFF control for lamp 2 and lamp 3 based on the result of the detection.

More specifically, heating control section 18 selects, based on the temperature detected by temperature sensor 13, which of lamp 2 and lamp 3 is used, and controls, based on the temperature detected by temperature sensor 12, whether selected lamp 2 or lamp 3 is turned on or off.

Figures 7A, 7B:
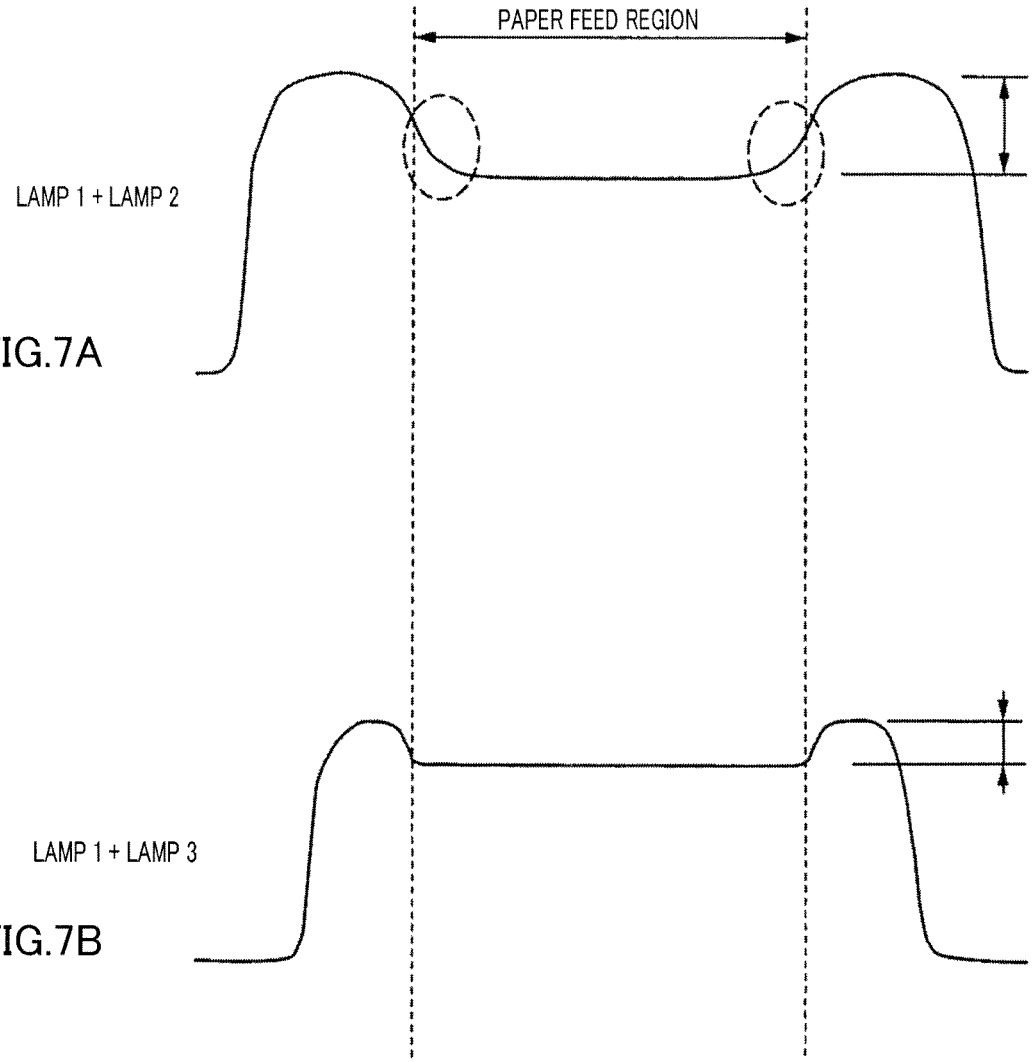
FIGS. 7A to 7B are diagrams for explaining that a temperature rise outside a paper feed region is reduced by changing the combination of edge-side lamps.

For example, as shown in FIG. 7A, when lamp 1 and lamp 2 are energized, the temperature of a non-paper feed region abnormally rises, whereby a fixing roller, a fixing belt, and the like arranged in a non-paper feed section are thermally damaged. Even in a paper feed region, since the temperature of the vicinity of paper feed region ends also tends to rise, a non-uniform temperature distribution occurs across a sheet and gloss across the sheet sometimes changes.

In this embodiment, when an abnormal temperature rise outside the paper feed region, such as that shown in FIG. 7A, occurs, the abnormal temperature rise is detected by temperature sensor 13. A lamp to be used is switched from lamp 2 to lamp 3. As a result, as shown in FIG. 7B, a temperature rise in the non-paper feed region is limited whereby the temperature distribution across the paper feed region is made uniform.

FIG. 8 shows a table for lamp switching provided in heating control section 18. In the table for lamp switching, set temperature values are stored, which are indices for switching between lamps 2 and 3 based on the temperatures detected by temperature sensors 12 and 13. The set temperature value is unique to each of the outputs from temperature sensors 12 and 13. The set temperature values are set for different sheet sizes (i.e., sheet widths). Numerical values in the drawing are relative values to a fixing target temperature (which may also be referred to a target temperature of temperature sensor 11 at the center). For example, when the fixing target temperature is 200° C., −40° C. in the drawing indicates 160° C., and 0° C. in the drawing indicates 200° C.

For example, when paper is large-sized paper such as A3 size (297 mm in width) paper and the fixing target temperature is 200° C., according to FIG. 8, a set temperature value for temperature sensor 12 (and temperature sensor 11) is 200° C. and a set temperature value for temperature sensor 13 is 210° C. Therefore, when the temperature detected by temperature sensor 13 exceeds 210° C., heating control section 18 switches the edge lamp to be used from the large edge lamp (lamp 2) to the small edge lamp (lamp 3) to prevent a rise in edge-portion temperature while keeping the temperature across the sheet at a predetermined level.

When paper is small-sized paper that is 160 mm or less in width, a set temperature value for temperature sensor 12 is set to an extremely low temperature of 200° C.-40° C. Therefore, edge lamps 2 and 3 are hardly turned on and heating is performed by only center lamp 1. As a result, it is possible to keep the temperature across the sheet while preventing a rise in edge-region temperature when a small-sized paper sheet is fed.

In the case of A3 size (297 mm in width) sheet, a set temperature value for temperature sensor 13 is +10° C. When this value is set to 0° C., this seems to be convenient because the edge-portion temperature outside of the paper feed region is equalized to the temperature of the sheet. However, when continuous printing is performed, the temperature of the sheet near the edge drops to a level lower than the edge-portion temperature outside the paper feed region (i.e., temperature detected by temperature sensor 13). Taking this into account, in this embodiment, in the case of sizes equal to or larger than A3 size or so (i.e., a size equal to or larger than about 280 mm), the edge-portion temperature outside the paper feed region is set 10° C. higher to prevent fixability and glossiness of the sheet from falling. Incidentally, it has already been confirmed that, even if the temperature outside the paper feed region rises to a level about 10° C. higher than a set temperature, there is no damage to the fixing member at all.

Figures 9A, 9B, 9C, 9D, 9E, 9F:
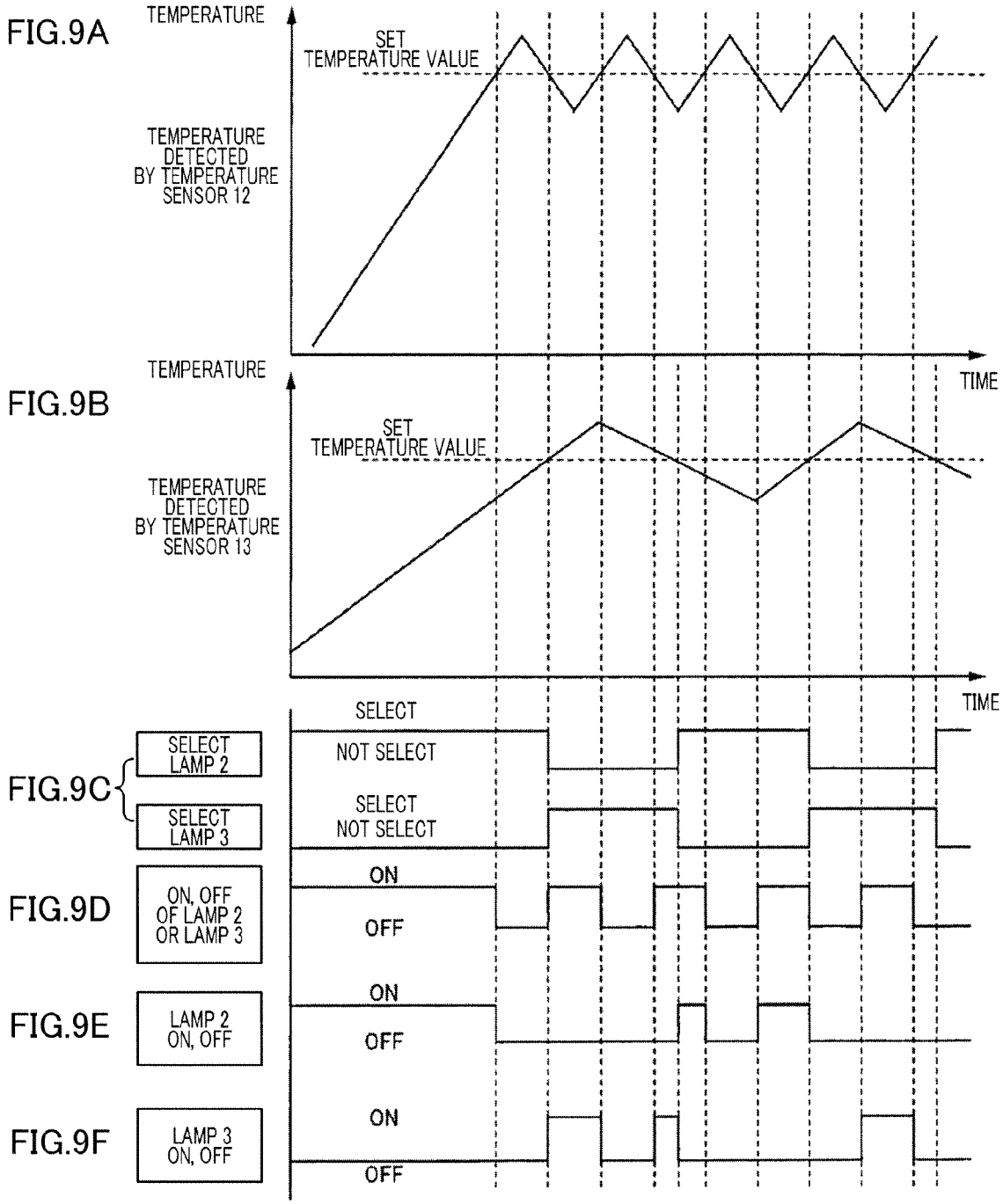
FIGS. 9A to 9F are diagrams showing control states of lamp 2 and lamp 3 by a heating control section.

FIG. 9 is a diagram showing control states of lamp 2 and lamp 3 by heating control section 18. FIG. 9A shows a temperature profile detected by temperature sensor 12. FIG. 9B shows a temperature profile detected by temperature sensor 13. FIG. 9C shows which of lamp 2 and lamp 3 is selected based on the temperature detected by temperature sensor 13 and on a set temperature value. FIG. 9D shows whether lamps 2 and 3 are turned on or off based on the detected temperature by temperature sensor 13 and the set temperature value. FIG. 9E shows an ON/OFF state of lamp 2. FIG. 9F shows an ON/OFF state of lamp 3. The set temperature values shown in FIGS. 9A and 9B are the set temperature values shown in FIG. 8.

As shown in FIGS. 9B and 9C, when the temperature detected by temperature sensor 13 provided outside heat generating regions h2 and h3 is equal to or lower than the set temperature value, the large edge-side lamp (lamp 2) is selected. When the detected temperature is higher than the set temperature value, the small edge-side lamp (lamp 3) is selected.

As shown in FIGS. 9A and 9D, when the temperature detected by temperature sensor 12 provided at the position where end heat generating regions h2 and h3 overlap is equal to or lower than the set temperature value, power supply to the selected lamp shown in FIG. 9C is performed. On the other hand, when the temperature detected by temperature sensor 12 is higher than the set temperature value, the power supply to the selected lamp shown in FIG. 9C is stopped.

In other words, heating control section 18 calculates, for each of lamp 2 and lamp 3, AND of a lamp selection result shown in FIG. 9C and a determination result of power supply to the lamps shown in FIG. 9D to thereby control ON/OFF of lamp 2 and lamp 3 as shown in FIGS. 9E and 9F.

Summarizing the above explanation, main features of the heating roller according to this embodiment lies in configurations explained below.

(i) The heating roller includes lamp 1 for heating the center region, lamp 2 for heating large edge regions, and lamp 3 for heating small edge regions.

(ii) In addition to temperature sensor 11 arranged at a position corresponding to heat generating region h1 of center lamp 1 and temperature sensor 12 arranged at a position corresponding to heat generating regions h2 and h3 of edge-side lamps 2 and 3, the heating roller includes temperature sensor 13 arranged at a position outside heat generating regions h1, h2, h3 (i.e., arranged in the paper non-contact edge portion).

(iii) It is selected based on a detection result from temperature sensor 13 which of lamp 2 and lamp 3 is turned on.

In the fixing device according to this embodiment, with the configuration (i), it is possible to accommodate various sheet sizes with low power consumption while reducing flickering as compared with a configuration accommodating a large-sized sheet with one lamp. With the configurations (ii) and (iii), it is possible to limit a temperature rise in the paper non-contact edge portions. As a result, it is possible to make uniform the temperature distribution across the paper feed region and to prevent damage to the fixing member.

The configuration of this embodiment is now compared with the configurations in comparative examples.

Figures 10, 11:
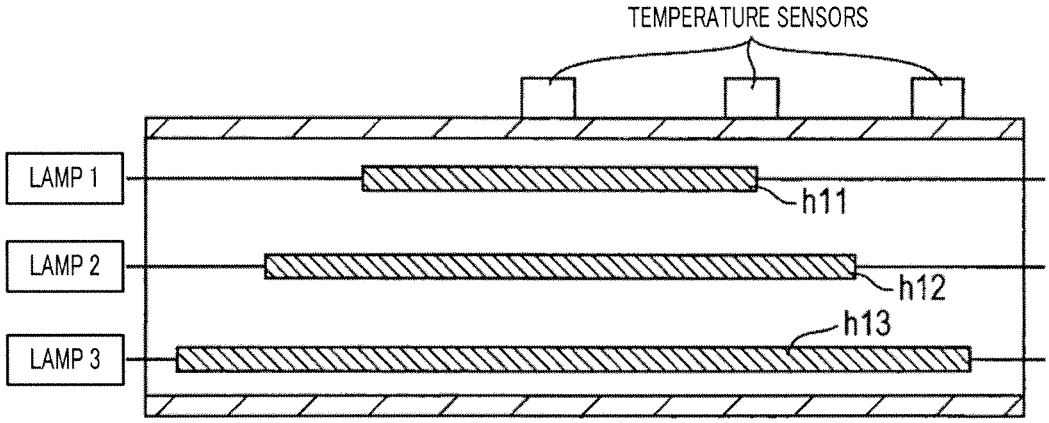
FIG. 10 is a sectional view showing a configuration in Comparative Example 1.
FIG. 11 is a diagram showing relative superiority of performance in an embodiment over Comparative Example 1.

FIG. 10 shows a configuration in Comparative Example 1. In the configuration in Comparative Example 1, lamps 1, 2, 3 respectively include heat generating regions h11, h12, h13 for different sheet sizes. In the configuration in Comparative Example 1, during fixing for a small-sized sheet, lamp 1 is turned on to cause heat generating region h11 to generate heat. During fixing for a medium-sized sheet, lamp 2 is turned on to cause heat generating region h12 to generate heat. During fixing for a large-sized sheet, lamp 3 is turned on to cause heat generating region h13 to generate heat.

FIG. 11 shows relative superiority of performance in an embodiment (FIG. 1) over Comparative Example 1 (FIG. 10). In Comparative Example 1, since the lamps having long heat generating regions are used, flickering tends to occur. In Comparative Example 1, since an edge-portion temperature is not taken into account, it is likely that the edge-portion temperature rises.

Figures 12, 13:
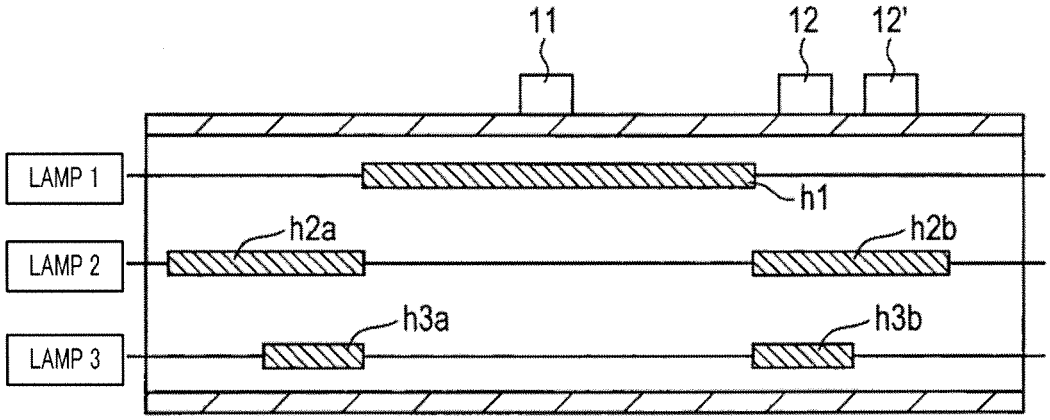
FIG. 12 is a sectional view showing a configuration in Comparative Example 2.
FIG. 13 is a diagram showing relative superiority of performance in an embodiment over Comparative Example 2.

FIG. 12 shows a configuration in Comparative Example 2. The configuration in Comparative Example 2 is different from the configuration in Embodiment 1 in that temperature sensor 12' is arranged within a range of heat generating regions h2*a* and h2*b* (at the edge of the paper feed region) rather than at a position outside heat generating regions h1, h2, h3 (i.e., in the paper non-contact edge portion) where temperature sensor 13 in the embodiment (FIG. 1) is arranged.

FIG. 13 shows relative superiority of performance in an embodiment (FIG. 1) over Comparative Example 2 (FIG. 12). In Comparative Example 2, since the temperature of the paper non-contact edge portions is not taken into account (i.e., since accurate temperature outside the paper feed region cannot be grasped), it is likely that the edge-portion temperature rises. Specifically, temperature sensor 12' in Comparative Example 2 is present at a position corresponding to heat generating region h2 of large edge-side lamp 2. Therefore, an edge-portion temperature rise due to warming of the fixing device itself cannot be detected. Temperature sensor 12' is inappropriate as a switching sensor for edge-side lamps for switching between large edge-side lamp 2 and small edge-side lamp 3. At the position of temperature sensor 12' in the configuration of Comparative Example 2, when a large-size sheet is fed, even if the temperature outside the paper feed region rises, determination of switching from large edge-side lamp 2 to small edge-side lamp 3 cannot be appropriately performed. Therefore, uniformity of the temperature distribution across the sheet is small compared to that in the embodiment. As explained above, an effect of arranging temperature sensor 13 at a position outside heat generating regions h1, h2, h3 (i.e., paper non-contact edge portion) as in the embodiment is large.

The invention devised by the inventor is specifically explained above based on the embodiment. However, the present invention is not limited to the embodiment and can be modified without departing from the spirit of the invention.

The embodiment described above is directed to an embodiment in which the present invention is applied to a fixing device of center paper feed type. However, the present invention may be applied to a fixing device of edge paper feed type.

Figure 14:
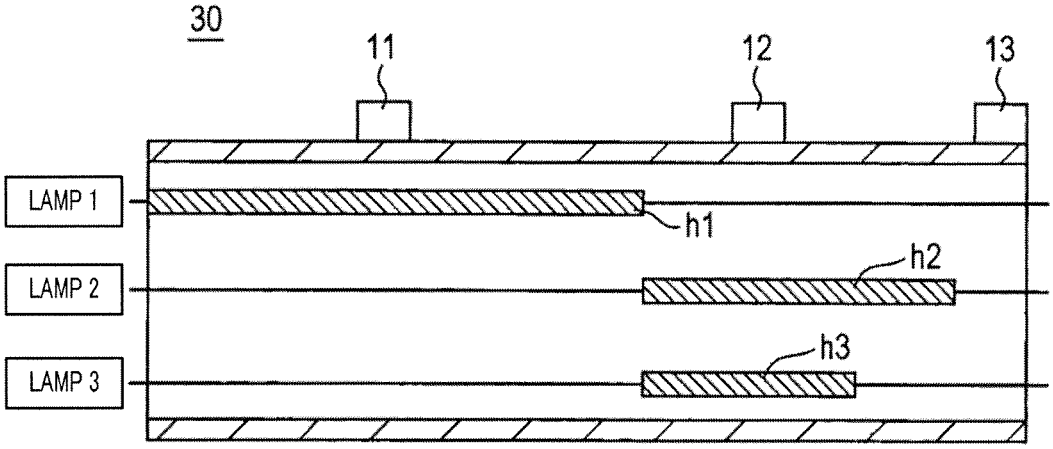
FIG. 14 is a sectional view showing a configuration of the heating roller according to another embodiment.

FIG. 14 is a sectional view showing a configuration of a heating roller of the fixing device of edge paper feed type to which the present invention is applied. In FIG. 14, components corresponding to those shown in FIG. 1 are denoted by reference signs same as those in FIG. 1. In heating roller 30 shown in FIG. 14, heat generating region h1 of lamp 1, heat generating region h2 of lamp 2, and heat generating region h3 of lamp 3 are formed so as to be capable of heating differently-sized sheets that are fed with their sides aligned to the left edge of the heating roller. The length of heat generating region h2 is a sum of the lengths of heat generating regions h2*a* and h2*b* shown in FIG. 1. The length of heat generating region h3 is a sum of the lengths of heat generating regions h3*a* and h3*b* shown in FIG. 1. When a small-sized sheet is fed, heat generating region h1 generates heat. When a large-sized sheet is fed, heat generating regions h1 and h2 generate heat. When a medium-sized sheet is fed, heat generating region h3 generates heat.

Temperature sensor 11 is arranged at a substantially center position of heat generating region h1. Temperature sensor 12 is arranged at a position where heat generating regions h2 and h3 overlap each other. Temperature sensor 13 is arranged at a position outside heat generating region h2 (i.e., arranged in the paper non-contact edge portion).

In the configuration shown in FIG. 14, as in the embodiment described above, when ON/OFF of edge-side lamps 2 and 3 is controlled based on the detection results from temperature sensors 11 to 13, effects comparable to those attained in the embodiment can be attained.

Figure 15:
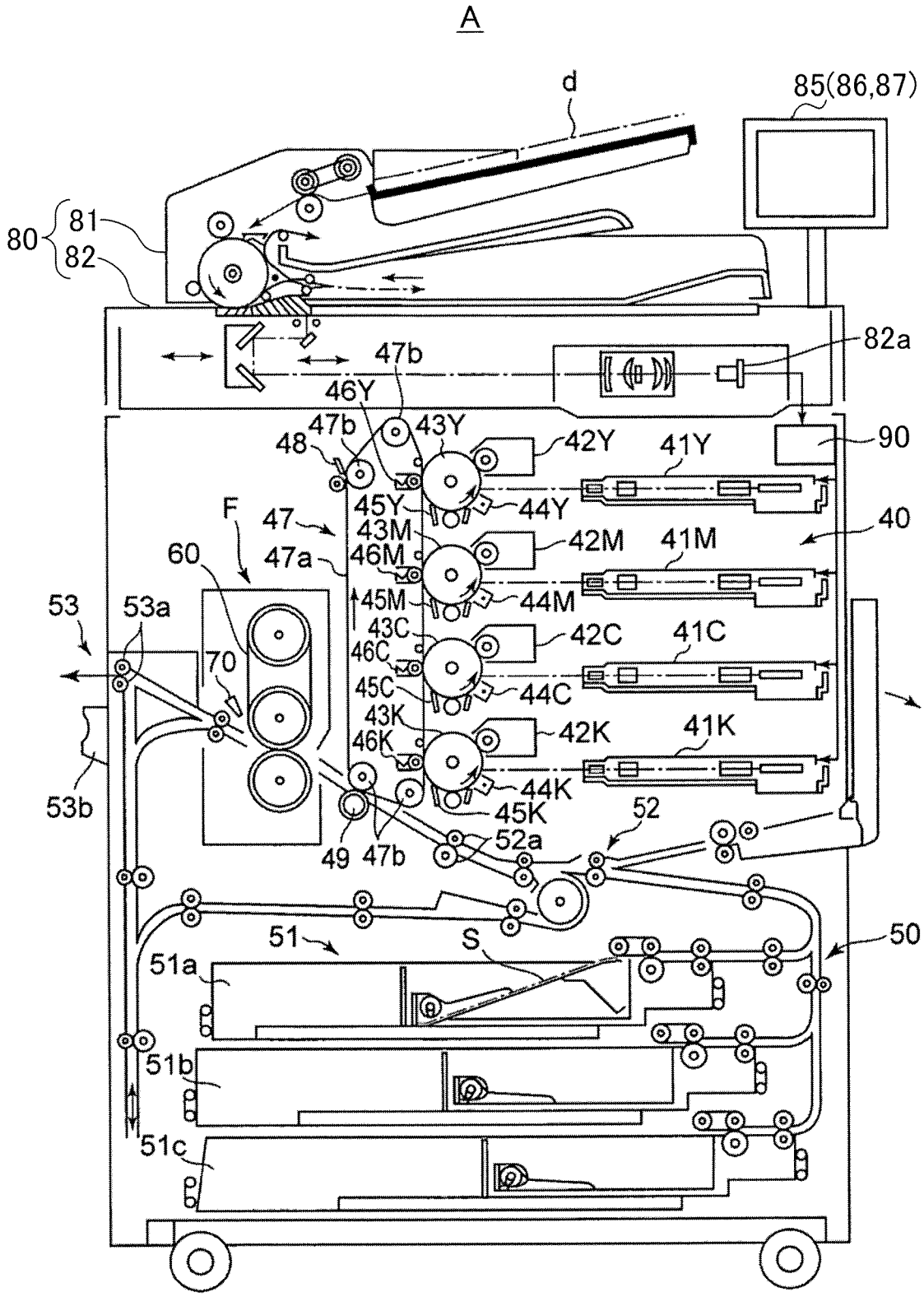
FIG. 15 is a diagram showing a schematic configuration of an image forming apparatus including a fixing device according to an embodiment.

FIG. 15 is a diagram showing a schematic configuration of an image forming apparatus including the fixing device according to this embodiment.

Image forming apparatus A shown in FIG. 15 forms an image by superimposing colors on sheet S based on image data acquired by reading a color image formed on an original document or image data input from an external information apparatus (e.g., a personal computer) via a network. Image forming apparatus A is a tandem-type image forming apparatus in which photoconductor drums (i.e., image bearing members) 43Y, 43M, 43C, 43K corresponding respectively to four colors of yellow (Y), magenta (M), cyan (C), and black (K) are arranged in series in a traveling direction of an image receiver (or intermediate transfer belt 47*a* in image forming apparatus A) so that respective color toner images are transferred onto the image receiver.

As shown in FIG. 15, image forming apparatus A includes image forming section 40, conveying section 50, image reading section 80, operation display section 85, image processing section 90, fixing section F, a control device (including, e.g., heating control section 18 shown in FIG. 3) and the like. The control device includes a central processing unit (CPU), a read only memory (ROM), a random access memory (RAM) and the like. The control device has a function of centrally controlling the operations of the respective blocks (image forming section 40, conveying section 50, image reading section 80, operation display section 85, image processing section 90, fixing device F, etc.) of image forming apparatus A. The control device also has a function of performing transmission and reception of various data to and from an external apparatus (e.g., a personal computer) connected to a communication network such as a local area network (LAN) or wide area network (WAN).

Image reading section 80 includes automatic document feeding device 81 called auto document feeder (ADF), document image scanning device (scanner) 82 and the like.

Automatic document feeding device 81 conveys an original document d placed on a document tray using a conveying mechanism and delivers the original document d to document image scanning device 82. Automatic document feeding device 81 can continuously and collectively read images (images on both sides) of a large number of original documents d placed on the document tray.

Document image scanning device 82 optically scans an original document conveyed onto a contact glass from automatic document feeding device 81 or an original document placed on the contact glass, focuses reflected light from the original document on a light receiving surface of charge coupled device (CCD) sensor 82*a*, and reads a document image. The image (i.e., analog image signal) read by image reading section 80 is subjected to predetermined image processing in image processing section 90.

Operation display section 85 includes a touch panel liquid crystal display (LCD) and the like, and functions as display section 86 and operation section 87. Display section 86 performs display of various operation screens, a state of an image, operation states of respective functions, and the like according to a display control signal input from the control device. Operation section 87 includes various operation keys such as a numeric keypad and a copy start key. Operation section 87 receives various kinds of input operations by a user and outputs a control signal to the control device.

Image processing section 90 includes circuitry such as for performing analog/digital (A/D) conversion processing and for performing digital image processing. Image processing section 90 applies the A/D conversion processing to the analog image signal from image reading section 80 to thereby generate digital image data (i.e., RGB signal). Image processing section 90 applies color conversion processing, correction processing (e.g., shading correction) corresponding to initial setting or user setting, compression processing, and the like to the digital image data. Image forming section 40 is controlled based on the digital image data (i.e., YMCK signal) subjected to these kinds of processing.

Image forming section 40 includes exposing devices 41Y, 41M, 41C, 41K, developing devices 42Y, 42M, 42C, 42K, photoconductor drums 43Y, 43M, 43C, 43K, charging devices 44Y, 44M, 44C, 44K, cleaning devices 45Y, 45M, 45C, 45K, and primary transfer rollers 46Y, 46M, 46C, 46K for different color components Y, M, C, K. Image forming section 40 further includes intermediate transfer unit 47, cleaning device 48, and secondary transfer roller 49.

In a unit for the Y component of image forming section 40, charging device 44Y charges photoconductor drum 43Y. Exposing device 41Y includes, for example, a semiconductor laser. Exposing device 41Y directs a laser beam corresponding to the Y component on photoconductor drum 43Y. Consequently, an electrostatic latent image of the Y component is formed on the surface of photoconductor drum 43Y. Developing device 42Y has stored therein a developer (e.g., a two-component developer containing a small particle size toner and a magnetic carrier) of the Y component. Developing device 42Y deposits a toner of the Y component on the surface of photoconductor drum 43Y to thereby develop the electrostatic latent image (i.e., form a toner image). In units for the M component, the C component, and the K component, respective color toner images are formed on the surfaces of photoconductor drums 43M, 43C, and 43K corresponding to the color components in the same manner.

In intermediate transfer unit 47, endless intermediate transfer belt 47*a* functioning as an image receiver is looped around a plurality of supporting rollers 47*b*. When intermediate transfer belt 47*a* is brought into press contact with photoconductor drums 43Y, 43M, 43C, 43K by primary transfer rollers 46Y, 46M, 46C, 46K, the respective color toner images are transferred onto intermediate transfer belt 47*a* (i.e., primary transfer) to be superimposed one on top of another on intermediate transfer belt 47*a*. Therefore, a color toner image is formed on intermediate transfer belt 47*a*. When intermediate transfer belt 47*a* is brought into press contact with sheet S by secondary transfer roller 49, the toner image is transferred from intermediate transfer belt 47*a* onto sheet S (i.e., secondary transfer).

Cleaning devices 45Y, 45M, 45C, 45K include, for example, a cleaning blade. Cleaning devices 45Y, 45M, 45C, 45K remove the toners remaining on the surface of photoconductor drums 43Y, 43M, 43C, 43K after the primary transfer. Cleaning device 48 also includes, for example, a cleaning blade. Cleaning device 48 removes the toners remaining on intermediate transfer belt 47*a* after the secondary transfer.

Conveying section 50 includes paper feeding device 51, conveying mechanism 52, paper discharge device 53 and the like. Paper feeding device 51 includes three paper feeding tray units 51*a* to 51*c*. In paper feeding tray units 51*a* to 51*c*, standard sheets and special sheets identified based on the basis weights, the sizes, and the like of sheets S are stored for each of the types set in advance. Sheets S stored in paper feeding tray units 51*a* to 51*c* are delivered one by one from sheets S at the top. Sheet S is conveyed to image forming section 40 by conveying mechanism 52 including a plurality of conveying rollers such as registration roller 52*a*. The toner image is transferred onto sheet S from intermediate transfer belt 47*a*. At this point, the tilt of fed sheet S is corrected and conveyance timing is adjusted by a registration section in which registration roller 52*a* is disposed.

Fixing section F includes fixing unit 60 including the fixing device according to this embodiment. Fixing section F fixes the toner image, which is transferred onto sheet S, to sheet S (fixing process). After the fixing process, sheet S is discharged to paper discharge tray 53*b* outside the apparatus by paper feeding device 53 including paper discharge roller 53*a*. Fixing section F may further include air separating unit 70 that facilitates separation of sheet S from fixing belt 22 by blowing the air to sheet S.

The embodiments disclosed herein should be considered illustrative and not restrictive in all aspects. The scope of the present invention is indicated by claims rather than the above explanation. It is intended that all modifications within meaning and a scope equivalent to claims are included in the scope of the present invention.

REFERENCE SIGNS LIST

10, 30 heating roller
11, 12, 12', 13 temperature sensor
15 to 17 switch
18 heating control section
21 fixing roller
22 fixing belt
23 lower roller
60 fixing unit
h1, h2, h2*a*, h2*b*, h3, h3*a*, h3*b*, h11, h12, h13 heat generating region
A image forming apparatus

The invention claimed is:

1. A fixing device that includes a heating roller incorporating therein heat generating lamps and is configured to heat a sheet having thereon a toner image to fix the toner image, the fixing device comprising:

a first heat generating lamp including a first heat generating region;

a second heat generating lamp including a second heat generating region in a region that corresponds to a region extending from an end of the first heat generating region and differs from the first heat generating region in an axial direction of the heating roller;

a third heat generating lamp including a third heat generating region in a region that corresponds to the region extending from the end of the first heat generating region and differs from the first heat generating region in the axial direction of the heating roller, the third heat generating region having a length different from a length of the second heat generating region, the third heat generating lamp being arranged such that the second heat generating region and the third heat generating region overlap each other in the axial direction of the heating roller;

a first temperature sensor arranged closer to an edge of the heating roller than are the first, second and third heat generating regions, the first temperature sensor being configured to detect an edge-portion temperature of the heating roller;

a second temperature sensor arranged at a position corresponding to a position where the second and third heating generating regions overlap each other; and a heating control section configured to control heat generation such that detection results of the first and second temperature sensors are constant by selecting one of the second and third heat generating regions based on a detection result only from the first temperature sensor and controlling whether to perform heat generation of the selected heat generation region based on a detection result only from the second temperature sensor.

2. The fixing device according to claim 1, wherein, when sheet sizes have a relationship: a first sheet size<a second sheet size<a third sheet size, a length of the first heat generating region is large enough to cover a paper feed region for the first sheet size, the length of the second heat generating region is such that a sum of the length of the second heat generating region and the length of the first heat generating region is large enough to cover a paper feed region for the third sheet size, and the length of the third heat generating region is such that a sum of the length of the third heat generating region and the length of the first heat generating region is large enough to cover a paper feed region for the second sheet size.

3. The fixing device according to claim 1, wherein both of the second heat generating region and the third heat generating region are arranged on both sides of the first heat generating region.

4. The fixing device according to claim 1, wherein both of the second heat generating region and the third heat generating region are arranged on one side of the first heat generating region.

5. The fixing device according to claim 1, wherein both of the second heat generating region and the third heat generating region do not overlap the first heat generating region in the axial direction of the heating roller.

6. The fixing device according to claim 1, wherein both of the second heat generating region and the third heat generating region overlap the first heat generating region in the axial direction of the heating roller.

7. An image forming apparatus comprising: a fixing device that includes a heating roller incorporating therein heat generating lamps and is configured to heat a sheet having thereon a toner image to fix the toner image, wherein the fixing device comprises:

a first heat generating lamp including a first heat generating region;

a second heat generating lamp including a second heat generating region in a region that corresponds to a region extending from an end of the first heat generating region and differs from the first heat generating region in an axial direction of the heating roller;

a third heat generating lamp including a third heat generating region in a region that corresponds to the region extending from the end of the first heat generating region and differs from the first heat generating region in the axial direction of the heating roller, the third heat generating region having a length different from a length of the second heat generating region, the third heat generating lamp being arranged such that the second heat generating region and the third heat generating region overlap each other in the axial direction of the heating roller;

a first temperature sensor arranged closer to an edge of the heating roller than are the first, second and third heat generating regions, the first temperature sensor being configured to detect an edge-portion temperature of the heating roller;

a second temperature sensor arranged at a position corresponding to a position where the second and third heating generating regions overlap each other; and a heating control section configured to control heat generation such that detection results of the first and second temperature sensors are constant by selecting one of the second and third heat generating regions based on a detection result only from the first temperature sensor and controlling whether to perform heat generation of the selected heat generation region based on a detection result only from the second temperature sensor.

8. The image forming apparatus according to claim 7, wherein, when sheet sizes have a relationship: a first sheet size<a second sheet size<a third sheet size, a length of the first heat generating region is large enough to a paper feed region for the first sheet size, the length of the second heat generating region is such that a sum of the length of the second heat generating region and the length of the first heat generating region is large enough to cover a paper feed region for the third sheet size, and the length of the third heat generating region is such that a sum of the length of the third heat generating region and the length of the first heat generating region is large enough to cover a paper feed region for the second sheet size.

9. The image forming apparatus according to claim 7, wherein both of the second heat generating region and the third heat generating region are arranged on both sides of the first heat generating region.

10. The image forming apparatus according to claim 7, wherein both of the second heat generating region and the third heat generating region are arranged on one side of the first heat generating region.

11. The image forming apparatus according to claim 7, wherein both of the second heat generating region and the third heat generating region do not overlap the first heat generating region in the axial direction of the heating roller.

12. The image forming apparatus according to claim 7, wherein both of the second heat generating region and the third heat generating region overlap the first heat generating region in the axial direction of the heating roller.

* * * * *